United States Patent [19]

Capriotti et al.

[11] 4,074,439

[45] Feb. 21, 1978

[54] MOLD DISCHARGE RACK GAPPING APPARATUS

[75] Inventors: Alfred J. Capriotti, Falls Township, Bucks County; Louis G. Lazzaretti, Economy Borough; Brian O'Donnell, Bristol Township, Bucks County, all of Pa.

[73] Assignee: United States Steel Corporation, Pittsburgh, Pa.

[21] Appl. No.: 645,597

[22] Filed: Dec. 31, 1975

[51] Int. Cl.[2] ..... G01C 15/00

[52] U.S. Cl. ..... 33/286; 33/182; 164/440; 164/412

[58] Field of Search ..... 33/182, 286, 181 R, 33/180 R; 164/282, 412

[56] References Cited

U.S. PATENT DOCUMENTS

| | | | |
|---|---|---|---|
| 3,863,356 | 2/1975 | Bengel et al. | 33/286 |
| 3,967,362 | 7/1976 | Capriotti et al. | 164/282 |

*Primary Examiner*—William D. Martin, Jr.
*Attorney, Agent, or Firm*—William A. Danchuk

[57] ABSTRACT

A method and apparatus employed in the spacing and gapping the product containing rollers contained within a plurality of continuous casting discharge racks. Both the method, and apparatus with which the method is employed, insure the accurate gapping of the discharge rack rollers from a specific centerline, the latter being in a given spacial relationship with a given benchmark located upon the rack per se such that the centerlines of a plurality of such racks are collinearly aligned when positioned using their respective benchmarks within a continuous casting machine.

10 Claims, 5 Drawing Figures

MOLD DISCHARGE RACK GAPPING APPARATUS

BACKGROUND OF THE INVENTION

The continuous casting method of producing steel product, as well as the basic machinery necessary for the employment of such method, have been well known in the steel industry for some time. This is not to suggest that continuous casting machines are simple in either their substance or operation. In fact, continuous casters are multi-element machines which must be precisely "tuned" for their proper operation.

In order to provide for both efficient operation of the caster, as well as good product formation, it is necessary to align the components of the continuous caster to within relatively strict limits. The alignment methods which have been employed in the past have, in part, employed the use of plumb-bobs and straight edges from points proximate the mold to the curved rack portion of the caster. It should be obvious that the employment of such methods and measuring apparatus are both cumbersome and dangerous as well as time consuming. The amount of downtime for the casting equipment during its alignment within the continuous casting machine itself is far in excess of what it optimally should be. This is especially important when considered in light of both labor as well as equipment costs.

The casting requirements dictated by the number of tons of steel which must be cast, as well as the expense of downtime, necessitate the quick alignment of the elements of the continuous caster. Among these various elements are included the discharge racks employed to contain the semi-molten product as it is passed from the discharge end of the mold to the curve rack rollers of the continuous casting machine. It would be highly desirable, as well as efficient, to provide for the alignment of the discharge racks outside of the continuous casting machine such that a quick substitution of specific elements may be made for those elements within the caster which have broken down or become misaligned. Additionally, there is the need for a more efficient and accurate method and apparatus for achieving alignment of the discharge rack units themselves, without resort to straight edges, plumb-bobs and the like.

SUMMARY OF THE INVENTION

The present invention is addressed to a method and apparatus employed in the alignment of the discharge rack rollers of a continuous casting machine. The method might be practiced without the use of the alignment apparatus. However, it is desirable, as well as efficient, to practice the alignment method in connection with the apparatus according to the present invention.

The apparatus, in its most fundamental form, is configured as a support table having a plurality of pads located thereon which are operative to receive and support a given discharge rack. Located on the planar table is an extension having a configuration which is dimensionally representative of the product to be cast through the rollers contained within the discharge rack. Thus, the rollers of the rack are moved and oriented into a position about the extension such that they are in a "casting position" relative to the extension, and therefore the product which is represented thereby.

Also located on the table are elements for positioning the discharge rack, and a given benchmark located thereon, relative to a given benchmark on the table. Thus, each discharge rack which is gapped and spaced relative to the extension, and its centerline, is gapped relative to the same given benchmark throughout the number of racks so adjusted. As a result, the discharge racks, and their respective centerlines, may be collated relative to the benchmarks, thus insuring the collinear alignment of each discharge rack's centerline.

It is therefore a primary object and feature of the present invention to provide a method and apparatus, to be employed in the practice of the method, for aligning a plurality of continuous casting discharge racks such that the centerlines of all of such discharge racks are collinearly aligned when positioned in operative association with one another in the continuous casting machine.

It is a further primary object and feature of the present invention to provide an apparatus for aligning and supporting a continuous casting discharge rack out of its position within the continuous casting machine.

It is a general object and feature of the present invention to provide a method and apparatus to be employed in the alignment of discharge rack components of a continuous casting machine at a location removed from the continuous casting machine per se, thereby providing for the substitution of the aligned discharge rack components of the continuous casting machine for similar components within the machine which, for some reason, must be removed.

It is another object and feature of the present invention to provide a method and apparatus to be employed for the alignment of various discharge rack components of a continuous casting machine in such a manner as to minimize the downtime required for adjustments of the components and their substitution into the continuous casting machine per se.

It is another object and feature of the present invention to provide a method and apparatus to be employed in the alignment of a number of different sized discharged rack components of a continuous casting machine at a location removed from the continuous casting machine per se such that substitution of pre-aligned components may be achieved in such a manner as to minimize the downtime required for adjustments of the discharge racks within the machine.

Other objects and features of the invention will, in part, be obvious and will, in part, become apparent as the following description proceeds. The features of novelty which characterize the invention will be pointed out with particularity in the claims annexed to and forming part of the specification.

BRIEF DESCRIPTION OF THE DRAWINGS

The novel features that are considered characteristic of the invention are set forth with particularity in the appended claims. The invention itself, however, both as to its structure and its operation together with the additional objects and advantages thereof will best be understood from the following description of the preferred embodiment of the invention when read in conjunction with the accompanying drawings wherein:

DETAILED DESCRIPTION OF THE INVENTION

Figure 1:
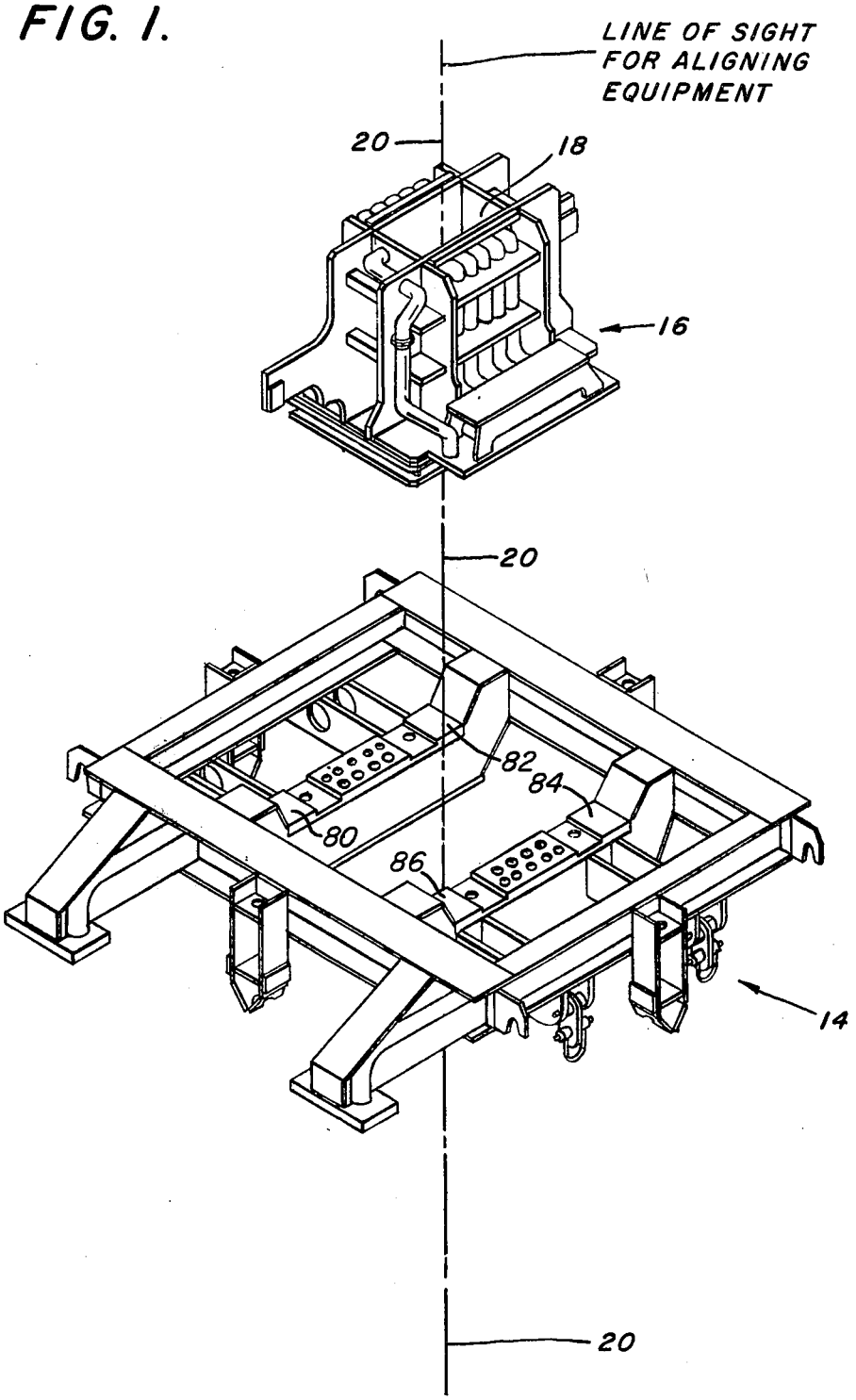
FIG. 1 is an isometric view of the portion of the continuous casting machine which is to be aligned.
Figure 2:
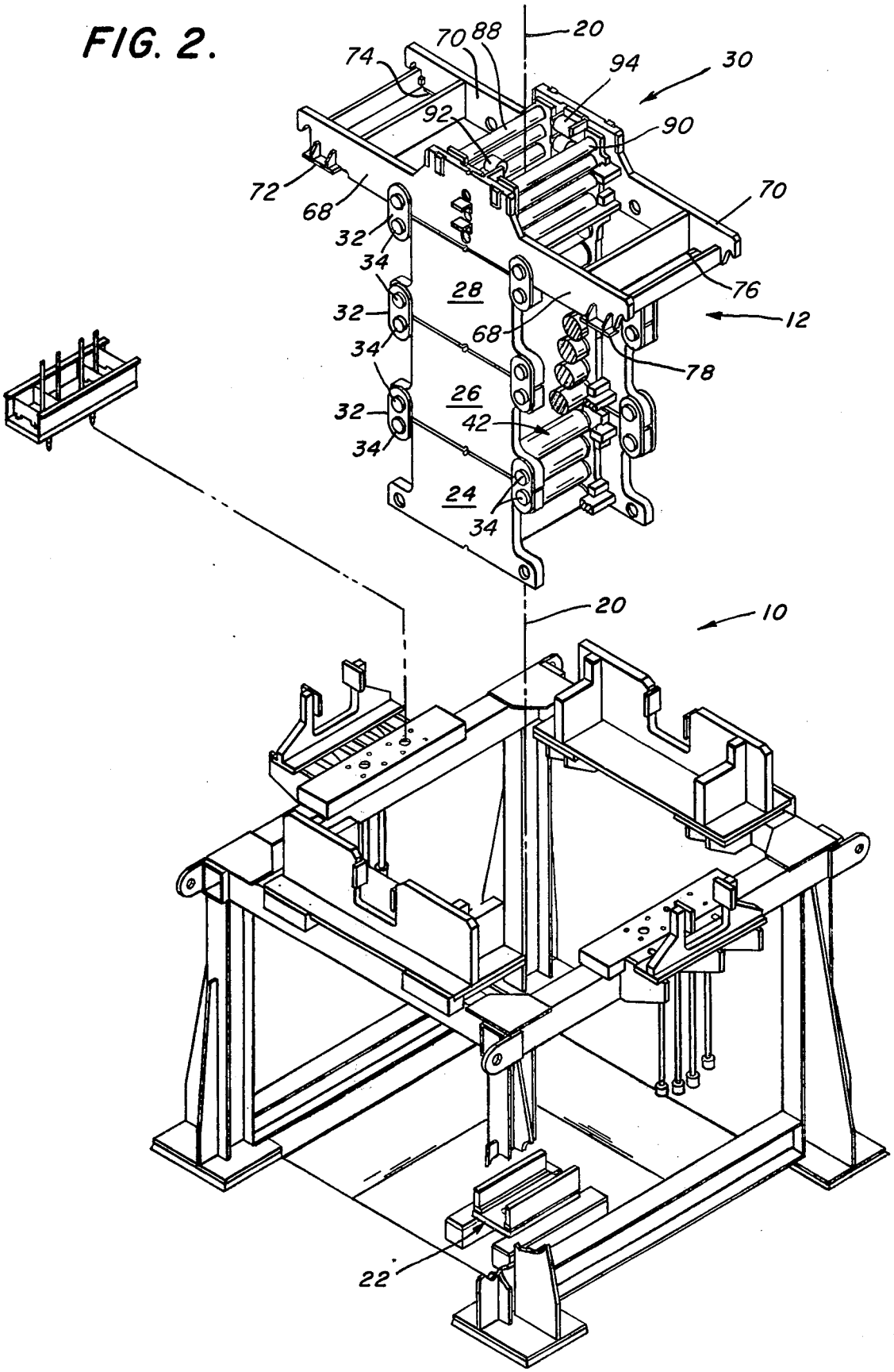
FIG. 2 is an isometric view of additional components of the continuous casting machine and is a continuation of FIG. 1 showing additional portions of the continuous casting machine to be aligned.

Referring to FIGS. 1 and 2, the latter being a continuation of the former from below, there is shown a plurality of components of a continuous casting machine and their relationship to one another and to a test and alignment stand shown generally at 10. The test and alignment stand 10 supports a plurality of casting machine components generally, including a discharge rack 12, a mold oscillator table 14, and a mold support 16 within which is inserted a mold 18. The combination of these various components of the continuous casting machine represent from the mold 18 through the discharge rack 12 the initial components of the casting machine just prior to the bending rack (not shown) which begins to move the product from a vertical orientation to a horizontal orientation. A line 20 represents the centerline of the product as it passes through each component of the continuous casting machine from the mold to the discharge rack 12. In a preferred embodiment of the invention, it is this line from which the width and depth dimensions of each discharge rack is made. Positioned at the bottom of the stand 10 is a target assembly 22 having a target therein (not shown) which represents the continuation of the centerline 20 into the curved rack portion (not shown) of the remainder of the continuous casting machine.

The discharge rack 12 is generally composed of four sections: a lower rack section 24 which is located in overlying relationship to the curved rack portion of the remainder of the continuous casting machine; a middle rack section 26; an upper rack section 28; and an uppermost rack section 30. The rack sections are retained together by a series of links 32 extending between each of the sections which, in combination with a plurality of pins 34, join each of the sections to those adjacent to it. When positioned within the continuous casting machine (not shown), rack sections 28, 26 and 24 are hung from the uppermost rack section 30 by the use of the pins 34, links 32 and holes located in the rack sections per se, as will be described below. It is thus important to have each of the above-described rack sections aligned with each of the others, such that their respective centerlines are collinearly aligned for effecting a common product pass line through the continuous casting machine.

Figure 5:
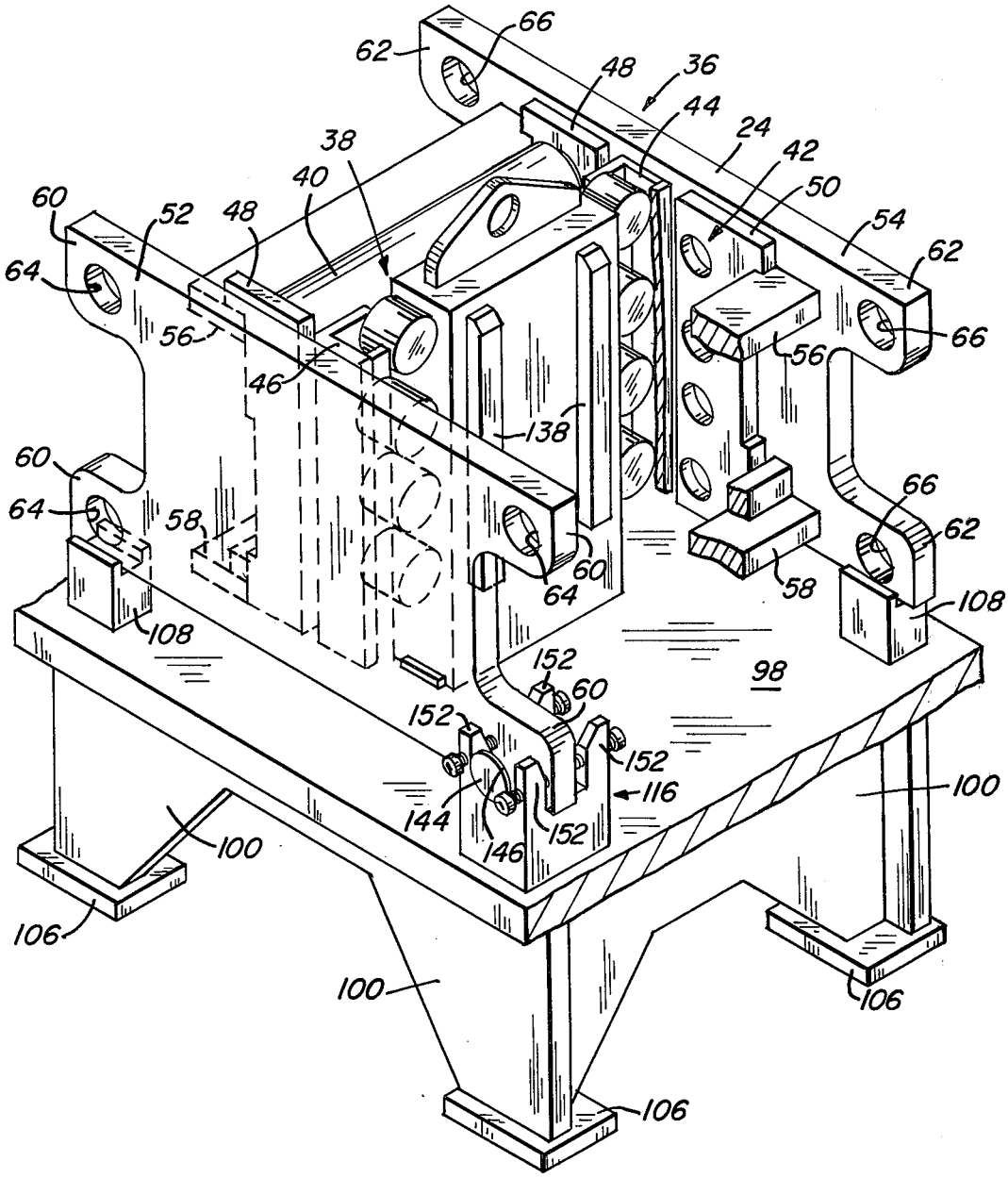
FIG. 5 is a perspective view of the gapping and spacing apparatus shown in FIGS. 3 and 4 with only one type of discharge rack located thereon.

Each of the rack sections 24, 26, 28 and 30 contain two pair of roller sets for containing the product as it is passed therethrough. For instance, FIG. 5 shows an exemplary roll rack such as 24 having a first set of edge rolls 36 and an oppositely-facing or oriented second set of edge rolls 38. Both sets 36 and 38 of edge rolls have parallel axes of rotation between the sets as well as within the individual sets per se. Oriented normally to edge roll sets 36 and 38 are two sets of width rollers 40 and 42 which extend along the width of the product and together define the product depth. The roller sets 36, 38, 40 and 42 are mounted within the discharge rack through the employment of roller support members 44, 46, 48 and 50, respectively. Each of the roller support members provides for the free rotation of each of the individual rolls in the roller set. In the preferred embodiment of the present invention, each of the four roller sets includes four rollers for a total of sixteen rollers per discharge rack.

The discharge racks 24, 26 and 28, an example of which may be seen by referring to FIG. 5, are configured having two major side walls 52 and 54 which support the remaining portions of the discharge rack. The rollers of roller sets 40 and 42 extend between the two side walls 52 and 54 and the edge roll sets 36 and 38 extend parallel to the walls 52 and 54. Connecting beams, such as those shown at 56 and 58 extend between the walls 52 and 54 on the outside of roller sets 40 and 42 and both support and separate the two walls in a parallel fashion to one another. Means (not shown) are also provided within each of the discharge racks for adjusting the roller sets inwardly or outwardly relative to a centerline of the product to be passed therethrough. The specific mechanisms for achieving these adjustments, such as set screws and the like, are commonly known in the art, and for purposes of time and clarity, will neither be shown nor described here.

Located at each of the four corners of the two side walls 52 and 54 are extensions 60 and 62, respectively. Bores 64 are located in extensions 60 and, in a similar manner, bores 66 pass through the extensions 62 in side wall 54. It is through the use of these bores, 64 and 66, and the associated pins 34 and links 32, that a plurality of the discharge rack units are hung from one another in their operative state within the continuous casting machine. When so hung, there must exist a collinear relationship between the centerlines of each individual discharge rack 24, 26 and 28 with the others. It is for this purpose, among others, that the present apparatus and method have been developed. As noted previously, the three rack sections 24, 26 and 28 are all similar in design and reasonable detail. The only one of the four previously discussed discharge racks which is any different in physical appearance is the uppermost discharge rack 30.

The uppermost discharge rack 30 is configured having laterally spaced arms 68 and 70 which are employed for supporting the discharge rack 12 within the continuous casting machine. Located at each of the four corners defined by the extensions 68 and 70 are four pads 72, 74, 76 and 78, which in conjunction with four support pads 80, 82, 84 and 86 located on the mold oscillator table 14, respectively, (see FIG. 1), support the four discharge racks 24, 26, 28 and 30. In addition, discharge rack 30 includes two sets of width rollers 88 and 90 and two sets of edge rollers 92 and 94. The diameter of the rollers contained within discharge rack 30 is 4 inches. The diameter of the rollers contained within the remaining racks 24, 26 and 28, however, is 6 inches. This disparity leads to one area of difficulty in aligning all of the discharge racks from a common reference centerline.

Located above the discharge rack 12 is the mold oscillator table 14, which not only provides support for the mold support 16, the mold 18, and the discharge rack 30, but oscillates the latter as is well known in the art. The mold oscillator table 14 is supported within the continuous caster on a plurality of eccentric cams (not shown) which provide the oscillating movement to the table and to the mold and mold support. The mold and mold support 18 and 16, respectively, are conventionally formed and contain all the necessary cooling elements and conduits for insuring their proper operation during the casting procedure.

The test and alignment stand 10 is located outside of the continuous casting machine per se, and as suggested previously, is operative to support and provide alignment for the above-noted components of the continuous casting machine. Additionally, the test and alignment stand 10 provides a convenient way in which to store the aligned components prior to their insertion within the continuous casting machine. For a more detailed explanation of the test and alignment stand 10 as well as its operation, reference should be made to a copending application for U.S. Patent by Alfred J. Capriotti and Louis G. Lazzaretti entitled "Continuous Caster Alignment Method and Apparatus", Ser. No. 596,035, filed on July 14, 1975, and assigned to the assignee of the present application. Accordingly, the specific method and apparatus for aligning the components of the continuous casting machine, of which the elements shown in FIGS. 1 and 2 are a part, will not be discussed here.

The first step which must be performed in a procedure for aligning the various components of the continuous casting machine is that of spacing or gapping the rollers contained within each of the rack sections 24, 26, 28 and 30. Such spacing and gapping must be done from a given centerline through the discharge rack which subsequently becomes the product pass line through the rack. Moreover, the establishment of the centerline within a given discharge rack must be made relative to a given point or benchmark on each subsequent discharge rack for proper collinear alignment of all the centerline of all the discharge racks being combined within the continuous casting machine. The specific apparatus, as well as the method, preferably employed relative to such an apparatus, may be best understood by referring to FIGS. 3, 4 and 5. In this regard, it should be noted that in FIGS. 3 and 4, both the four-inch section 30 and one of the 6 inch rack sections of the group 24, 26 or 28, are shown simultaneously for preserving space. Each of these different discharge racks is gapped and spaced upon the apparatus to be described independently of each other. The drawings are made for convenience in this regard and do not reflect any simultaneous gapping capability of the present gapping and spacing apparatus.

The gapping and spacing apparatus is shown generally at 96 and is configured as a horizontally-oriented table. The apparatus 96 includes a flat substantially planar support base 98, a plurality of legs or the like 100 which support the support base 98 in a generally horizontal orientation, and spacing and gapping extension 102 which extends normal to the plane of the support base 98 in a substantially vertical upward direction. Mounting holes, such as those shown at 104 are located in flanges 106 formed at the bottom of legs 100, provide for the permanent positioning of the table such that the support base 98 is in a generally horizontal position.

Located directly above each of the flanges 106 on the support base 98 are four discharge rack supporting and leveling blocks 108. The support blocks 108 are generally configured having a base portion 110 (FIG. 3) and a movable leveling portion 112, the latter being mounted for movement relative to the base portion 110 through two bolts 114 as seen on the left side of FIG. 3. By rotating the bolts 114, the movable leveling portion 112 may be raised or lowered to provide a leveling of the discharge rack about to be supported thereon. One of the support and leveling blocks 108 is configured somewhat differently from the other three. This one block, seen on the righthand side of the table in FIG. 3 and closest to the viewer in FIG. 5, includes a base portion 110, but includes a differently configured movable leveling portion 112. Specifically, the one block 108 includes a double-notched leveling portion 112 indicated at 116 which serves to both specifically locate the discharge rack and provide a portion of the means for moving the discharge rack correctly into position. These functions, and their relationship to the physical configuration of the notched portion 116 will be discussed in further elucidating detail below.

Also provided on the support base 98 of the table 96 are four pads 118, the purpose of which will be explained below. Wing members, as at 120 and 122, provide support for extensions 124 and 126 of the support base 98, respectively.

The element whose primary function is the gapping and spacing of the rollers contained within each of the discharge racks is the gapping and spacing extension 102. The extension 102 is removably mounted to the support base 98 of the table 96 through the use of a mortise and tenon arrangement 128 located below the surface of the support base 98. The arrangement 128 is formed from a mortise 130, located below and formed as a part of the support base of the table, and a tenon 132 formed as a lower extension of the gapping and spacing extension 102. A lock pin 134, configured to extend within appropriately located holes in both the mortise 130 and the tenon 132, provides for the locking of the extension 102 to the support base 98 in its generally vertical orientation.

Figure 3:
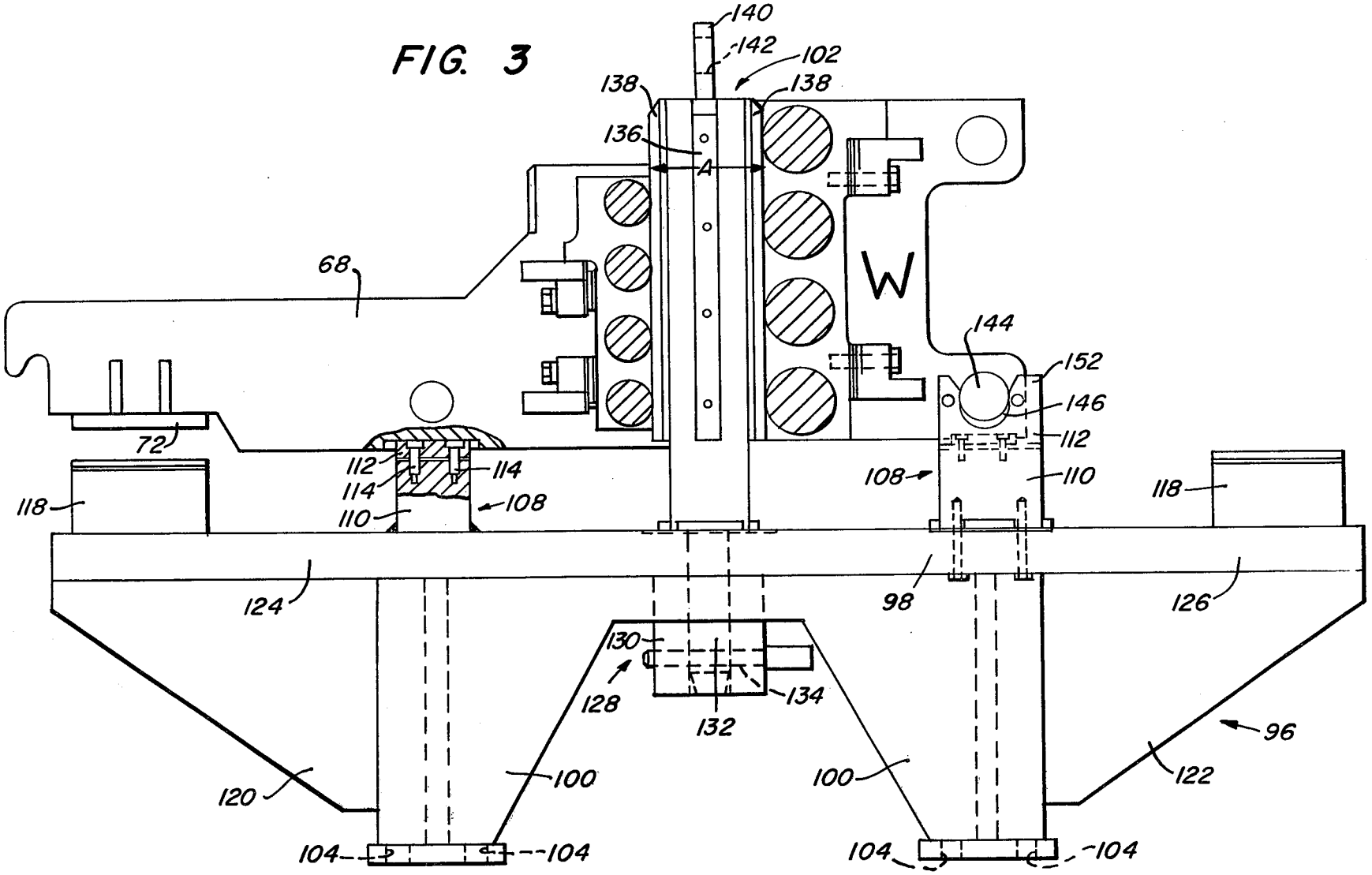
FIG. 3 is a front elevational view of the gapping and spacing apparatus according to the present invention in operative association with portions of two discharge racks to be aligned.
Figure 4:
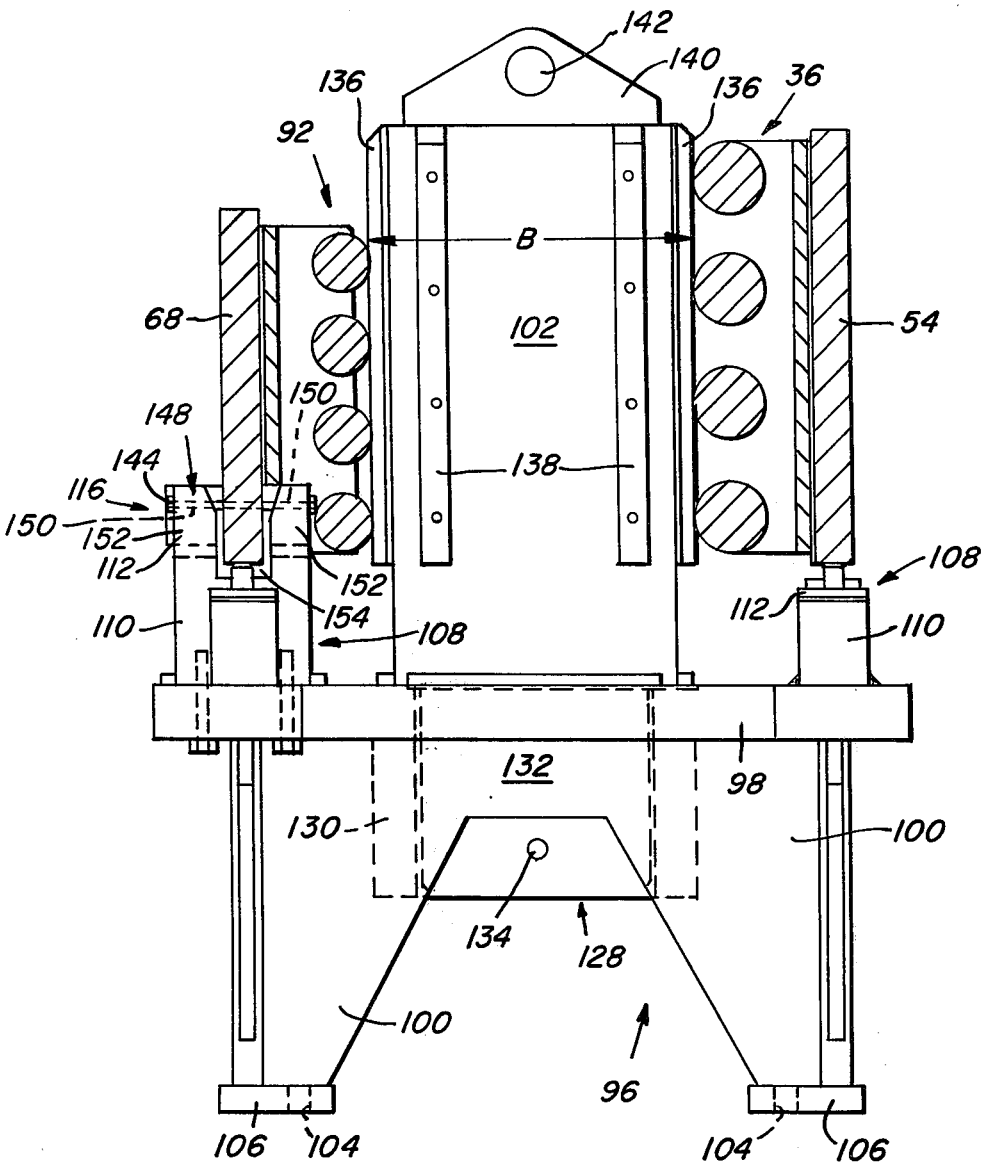
FIG. 4 is a side elevational view of the gapping and spacing apparatus of FIG. 3.

The extension 102 may be configured of a size having a depth dimension A and a width dimension B precisely equal to the depth and width dimensions, respectively, of the product to be passed through the discharge racks. Such would be one embodiment of the extension which function to gap and space correctly. However, in the preferred embodiment of the extension of the present invention, the extension 102 per se is of a width dimension and a depth dimension which is smaller than the product for which the rollers of the discharge racks are to be gapped and spaced. As a consequence, there are provided both width strips 136 and depth strips 138 on the extension 102 as indicated in FIGS. 3, 4 and 5. The strips 136 and 138 are attached to the extension 102 by any convenient means, such as screws or the like, and may be easily removed subsequent to their wear or damage. The dimensional sum of the depth and width dimensions of extension 102 and the depth and width strips 138 and 136 is just slightly smaller that both the depth and width of the product to be cast. Also provided on top of the extension 102 is a plate 140 having a hole 142 bored therein so as to provide a convenient mechanism for substituting one sized extension 102 for another differently sized extension. In this manner the extensions 102 along with their width and depth strips may be conveniently set up at a location removed from the table 96, thereby aiding in the efficiency of table usage should the need arise.

The remaining structure to be described relative to the gapping and spacing apparatus or table 96 will be done in conjunction with the method employed to correctly gap and space each of the discharge racks. Accordingly, that method will now be described.

In order to insure the correct location of a discahrge rack upon the assembly 96, all of the support and leveling blocks 108 should be set parallel to each other in a given horizontal plane. This is a preliminary step which is performed prior to the placement of a discharge rack upon the table and is achieved by movement of the movable leveling portions 112 of the blocks 108. It is assumed that the table assembly 96 has been leveled and the support base is horizontally oriented with the extension 102 extending in a vertical direction therefrom. Next, the dimensions of the extension 102 and its width and depth strips are checked to the desired width and depth as will have been priorly determined and set by the mold 18 used in the upper portion of the continuous casting machine. Should the dimensions of the extension 102 and its associated width and depth strips be out of step with the dimensions of the desired product, then appropriate shimming or substitution may be made to the width and depth strips to bring the total dimensions of the extension assembly to within the tolerance limitations of the product.

Prior to movement of a discharge rack into position on the table 98, a pin 144, comparable in size to the pins 34 priorly described, is inserted into the lower southwest hole 64 of the discharge rack section. This hole is found by referring to the letter "W" welded onto the west side frame of each discharge rack. The discharge rack is then mounted on the assembly 96 by placing it over the extension 102 and lowering it until the rack section seats on the pads formed as a portion of the leveling portions 112. The pin 144 which was inserted within the hole 64, falls within a comparably configured rounded notch portion 146 of the double notch assembly 116 a indicated in FIG. 3. The positioning of the pin 144 within the notch 146 provides for the specific location of the discharge rack in a direction parallel to the axis of rotation of the edge rolls contained therein. In order to provide for a specific location of the discharge rack in a direction parallel to the axis of rotation of the broader rolls 40 and 42, set screw mechanisms indicated at 148 are provided proximate the double notch assembly 116. The screw mechanisms consist of four inwardly-directed set screws 150 located on four leg portions 152 formed by the double-notched design 116, as shown in FIG. 4. When the discharge rack is located upon the apparatus 96, the set screws are adjusted to move the discharge rack so that the extension 60 of the side wall 52 lies centered within the notch 154 as may be seen in FIG. 4. Once this has been accomplished, the rollers of the discharge rack are now ready to be spaced and gapped with respect to the given point or benchmark established by the pin 144 and the set screws 150. Each of the discharge racks, whether of the group comprised of discharge racks 24, 26 or 28, or the discharge rack 30, is so oriented such that when hung together, all of the centerlines of all the discharge racks will be collinearly aligned. The specific manner of establishing these centerlines will now be described as the present alignment method proceeds.

When the discharge rack is positioned upon the apparatus 96, both the width and depth rollers are spaced from each other distances slightly greater than the respective dimensions of the extension 102 and its associated width and depth strips, 136 and 138, respectively. The reason behind this configuration is to promote both the location of the rack on the assembly 96, as well as the spacing and gapping of the rollers per se. While in the preferred embodiment of the invention there is the slight reduction (0.015 inches) of both width and depth dimensions of the extension 102 and width and depth strips, 136 and 138, respectively, this does not have to be the case in alternate embodiments. For instance, the dimensions of the extension 102, taken together with the width and depth strips, might be dimensionally exactly equal to the desired product width and depth dimensions. In such a case, the roller sets contained within the discharge rack would have to be spaced from each other distances greater than the desired width and depth in order to permit the easy placement of the discharge rack upon the assembly 96. The roller sets would then be moved into contact with the extension and locked, thereby spacing the rollers to the desired product size. The procedure followed relative to the preferred embodiment of the invention is slightly different however.

All of the four sets of width and depth rollers of the discharge racks are spaced from the width and depth strips by the employment of a feeler gauge at both the top and the bottom rollers of each set. In other words, the dimensions of the extension and strips of the preferred embodiment are almost, but not exactly equal to the product dimensions. It is this difference for which the feeler gauge is employed. Using this method, the four sets of rollers contained in the discharge rack are spaced from the extension 102 and locked in place, thereby establishing a centerline for each of the discharge racks so gauged and gapped. This centerline is then a given distance from the exact center of the southwest bore of the discharge rack; a standard used for each and every discharge rack which is to be gapped. Accordingly, when all of the discharge racks are aligned in the continuous casting machine, using their bores to hang them, all of the centerlines of the discharge racks will be aligned collinearly with respect to each other.

The discharge rack 30 is spaced in the same manner as the other three discharge racks 24, 26 and 28 just referred to. However, due to the fact that the discharge rack 30 rests upon the four support pads 72, 74, 76 and 78, an additional spacing measurement must be made.

The discharge rack 30, as noted previously, is supported on top of the mold oscillator table 14 through four support pads 72, 74, 76 and 78. It is accordingly desirable to orient the rack 30 in a level manner upon the table 14 so that the product passing therethrough will be oriented in a vertical direction. For this reason four pads 118 are provided on the outward edges of support base 98 of the gapping and spacing apparatus 96. During the gapping described relative to the discharge racks in general, the discharge rack 30 rests upon portions of the lateral arms 68 and 70. This situation may be best seen by referring to FIGS. 3 and 4. The rollers 88, 90, 92 and 94 are gapped and spaced in the same manner as described above with respect to the other discharge racks. As a result of this configuration just discussed, the pads 72, 74, 76 and 78 do not rest upon the pads 118 located beneath the pads 72, 74, 76 and 78, but are spaced therefrom a given distance. In order to correctly orientate the discharge rack 30 upon the mold oscillator table, it is necessary to adjust the pads 72, 74, 76 and 78 to a given standard distance from the pads 118. As a result, the rack 30, and all of the remaining discharge racks which hang from it, will be correctly oriented such that the product passing therethrough will be in a vertical orientation just prior to the bending unit (not shown) located below the lowest discharge rack 24.

When all four (or more) of the discharge rack rollers have been properly gapped and spaced relative to their given benchmark, i.e., the center of the southwest bore hole, they may be combined as shown in FIG. 2 to form the unitized discharge rack of a continuous casting machine. The rollers contained in each one of the racks are precisely spaced and gapped relative to a given centerline, transferred from the extension 102 to each one rack independently. Additionally, each of the centerlines has a given spacial relationship relative to the given benchmark on each of the discharge racks such that all of the centerlines of all of the discharge racks will be collinearly aligned when combined as shown.

The present method and apparatus is therefore instrumental in simplifying the previously complicated and time consuming method of gapping and spacing the discharge racks on an in-line basis relative to the continuous casting machine. It should be noted that the expense of downtime and manpower is drastically reduced while the accuracy and safety of roller spacing and centerline aligning is increased. The present invention provides for the further possibility of substitution of the gapping extension 102, thereby effecting even further downtime and expense.

While certain changes may be made in the above-noted method and apparatus without departing from the scope of the invention herein involved, it is intended that all matter contained in the above description or shown in the accompanying drawings shall be interpreted as illustrative and not in a limiting sense.

We claim:

1. Apparatus for accurately gapping and spacing a continuous casting discharge rack used in casting a steel product which is passed therethrough, such steel product having a given width dimension, a given depth dimension, a length dimension which is dependent upon the amount of material being cast and a centerline, such discharge rack including width and depth defining elements for defining a given width and a given depth dimension for such product, said gapping and spacing apparatus comprising:

a support base;

means for establishing a gapping and spacing standard for such width and depth defining elements, said gapping and spacing means being secured to said support base and extending outwardly therefrom, said spacing and gapping means providing a standard, at least along part of its extension, for the measurement of the width and depth dimensions of such width and depth defining elements, said gapping and spacing means having a centerline passing therethrough which is collinear with the centerline of the width and depth dimension to be measured therefrom;

means, connected to said support base, adapted to receive such discharge rack and establish a plane of support for such discharge rack upon said apparatus normal to the centerline of said gapping and spacing means; and means, formed as a portion of said means adapted to receive and establish a plane of support for the discharge rack, for precisely positioning a given benchmark point on successive discharge racks on said support base in a given spacial relationship to the centerline of said spacing and gapping means for establishing a common centerline through such successive discharge racks collinear with said centerline of said spacing and gapping standard establishing means, such that when a plurality of discharge racks are aligned in operational association with one another in a continuous casting machine, relative to the same given benchmark point on each, the centerlines through each discharge rack are aligned collinearly.

2. Apparatus for accurately gapping and spacing a continuous casting discharge rack used in casting a steel product which is passed therethrough, such steel product having a given width dimension, a given depth dimension, a length dimension which is dependent upon the amount of material being cast and a centerline, such discharge rack including width rollers and edge rollers for defining a given width and a given depth dimension for such product, said gapping and spacing apparatus comprising:

a support base;

means for establishing a gapping and spacing standard for such width and edge rollers, said gapping and spacing means being secured to said support base and extending outwardly therefrom, said spacing and gapping means being dimensionally representative, at least along part of its extension, of the width and depth dimensions of such product to be cast through such discharge rack, said gapping and spacing means having a centerline passing through the center of the width and depth dimensional representations along its extension;

means, connected to said support base, adapted to receive such discharge rack and establish a plane of support for such discharge rack upon said apparatus normal to the centerline of said gapping and spacing means; and means, formed as a portion of said means adapted to receive and establish a plane of support for the discharge rack, for precisely positioning a given benchmark point on successive discharge racks on said support base in a given spacial relationship to the centerline of said spacing and gapping means for establishing a common centerline through such successive discharge racks collinear with said centerline of said spacing and gapping standard establishing means, such that when a plurality of discharge racks are aligned in operational association with one another in a continuous casting machine, relative to the same given benchmark point on each, the centerline through each discharge rack are aligned collinearly.

3. The gapping and spacing apparatus of claim 2 in whcih such discharge rack includes at least one pair of oppositely-oriented roller sets for defining at last one of the width and depth dimensions for such product, said means for establishing a gapping and spacing standard including roller set separating means by which such at least one pair of oppositely-oriented roller sets may be gapped and set from each other a given distance from the centerline of such discharge rack.

4. The gapping and spacing apparatus of claim 2 in which such discharge rack includes two pairs of oppositely-oriented roller sets for defining both the width dimension and depth dimension for such product, said means for establishing a gapping and spacing standard including twin roller set separating means by which both pairs of such roller sets may be gapped and spaced from each other given distances from the centerline of such discharge rack equal to one-half of the width dimension and one-half of the depth dimension of the desired product to be passed therethrough.

5. The gapping and spacing apparatus of claim 2 in which said means for precisely positioning successive discharge racks includes means for aligning the centerline of a discharge rack in a first direction parallel to the depth dimension of such depth defining elements and in a second direction parallel to the width dimension of such width defining elements of such discharge rack when such discharge rack is located upon said apparatus.

6. The gapping and spacing apparatus of claim 2 in which said discharge rack support and receiving means is configured generally as a plane, said means adapted to receive such discharge rack and establish a plane of support for such discharge rack establishing a plane of support for such discharge rack substantially parallel to the plane of the support base, said means for establishing a gapping and spacing standard extending normally to the plane of said support base and the plane of support for such discharge rack.

7. The gapping and spacing apparatus of claim 2 in which at least a portion of said means for establishing a gapping and spacing standard is both dimensionally and substantially physically representative of a given length of product to be cast through such discharge rack, said means for establishing a gapping and spacing standard being used for gapping and spacing a successive number of discharge racks to a given width and depth of product dimension, said gapping and spacing standard establishing means being removable from said support base such that a dimensionally different gapping and spacing standard establishing means, having different width and depth dimensions, may be substituted therefor for gapping and spacing discharge racks for a dimensionally different product to be cast therethrough, said support base including means for releasably securing said gapping and spacing standard establishing means to said support base.

8. An apparatus for use in gapping and spacing at least one continuous casting discharge rack used in casting a steel product which is passed therethrough, such steel product having a given width dimension, a given depth dimension, a length dimension which is dependent upon the amount of steel being cast and a centerline, the discharge rack having a first two sets of oppositely-facing rollers for containing the steel product along its width, as it is passed between the sets of such rollers, and a second two sets of oppositely-facing rollers for containing the steel product along its depth, as it is passed between the second two sets of such rollers, said gapping and spacing apparatus comprising:

a support table including a generally planar base which is oriented in a substantially horizontal manner;

means for establishing a gapping and spacing standard for the discharge rack rollers, said gapping and spacing standard establishing means being configured substantially dimensionally similarly to a given length of such product with a given width and depth substantially equal to the width and depth of the product to be made, and extending normally from the plane of said support table, and having a centerline extending normal to the plane of said support table which dimensionally centered relative to the desired product width and depth measurements;

means, located on said support table, adapted to receive a discharge rack and establish a plane of support for the discharge rack upon said apparatus normal to the centerline of said gapping and spacing standard establishing means; and means, formed as a portion of said means adapted to receive and establish a plane of support for the discharge rack, for precisely positioning a given benchmark point on successive discharge racks on said support base in a given spacial relationship to the centerline of said spacing and gapping means for establishing a common centerline through such successive discharge racks collinear with said centerline of said spacing and gapping standard establishing means, such that when a plurality of discharge racks are aligned in operational association with one another in a continuous casting machine, relative to the same given benchmark point on each, the centerlines through each discharge rack are aligned collinearly.

9. The gapping and spacing apparatus of claim 8 in which said means for precisely positioning successive discharge racks includes means for aligning a discharge rack and its centerline in a first direction parallel to depth dimension of said means for establishing a gapping and spacing standard and in a second direction parallel to the width dimension of said means for establishing a gapping and spacing standard when such discharge rack is placed upon said apparatus.

10. The gapping and spacing apparatus of claim 8 in which said support table includes means for releasably securing said gapping and spacing standard establishing means to said support table, said gapping and spacing standard establishing means being removable from said support table such that a dimensionally different gapping and spacing standard establishing means having different width and depth dimensions may be substituted therefor for gapping and spacing discharge racks for a dimensionally different product to be cast therethrough.

* * * * *

UNITED STATES PATENT OFFICE

CERTIFICATE OF CORRECTION

Patent No. 4,074,439 Dated February 21, 1978

Inventor(s) Alfred J. Capriotti, Louis G. Lazzaretti and Brian O'Donnell

It is certified that error appears in the above-identified patent and that said Letters Patent are hereby corrected as shown below:

Column 8, line 48, after "gapping", insert -- procedure --.

Column 10, line 48, change "whcih" to -- which --.

Signed and Sealed this

*Fourth* Day of *July 1978*

[SEAL]

*Attest:*

RUTH C. MASON
*Attesting Officer*

DONALD W. BANNER
*Commissioner of Patents and Trademarks*